US006739052B2

(12) United States Patent
Pratt

(10) Patent No.: US 6,739,052 B2
(45) Date of Patent: May 25, 2004

(54) METHOD OF MAKING STRIPED METAL BEADS

(76) Inventor: Ronald Pratt, 223 Reservoir Rd., Cumberland, RI (US) 02864

( * ) Notice: Subject to any disclaimer, the term of this patent is extended or adjusted under 35 U.S.C. 154(b) by 96 days.

(21) Appl. No.: 10/126,821

(22) Filed: Apr. 19, 2002

(65) Prior Publication Data

US 2003/0196325 A1 Oct. 23, 2003

(51) Int. Cl.[7] ..... A44C 27/00

(52) U.S. Cl. ..... 29/896.43; 29/527.2; 29/896.4; 29/596.41; 29/896.42

(58) Field of Search ..... 29/896.4, 896.41, 29/896.411, 896.42, 896.43, 527.1, 527.2

(56) References Cited

U.S. PATENT DOCUMENTS 450,412 A * 4/1891 Knight ..... 428/614
973,153 A * 10/1910 Wolcott ..... 29/896.41
1,093,698 A * 4/1914 Heaton ..... 29/896.4
3,153,278 A * 10/1964 Martin et al. ..... 29/424
3,165,824 A * 1/1965 Barney ..... 29/411
3,165,825 A * 1/1965 Barney ..... 29/411
3,284,882 A * 11/1966 Marchesan ..... 29/433
3,636,616 A * 1/1972 Remning ..... 29/557
3,955,934 A * 5/1976 Tizzi ..... 428/573
4,354,301 A * 10/1982 Takeuchi et al. ..... 29/896.41
4,716,750 A * 1/1988 Tizzi ..... 72/52
6,274,250 B1 * 8/2001 Terziani ..... 428/579
6,376,104 B1 * 4/2002 Li et al. ..... 428/687
6,381,942 B1 * 5/2002 Grosz ..... 59/35.1
6,470,571 B1 * 10/2002 Namiki ..... 29/896.41
6,557,376 B2 * 5/2003 Pratt ..... 63/3
6,601,301 B2 * 8/2003 Lacchetti et al. ..... 29/896.411

* cited by examiner

*Primary Examiner*—Essama Omgba
(74) *Attorney, Agent, or Firm*—Cesari and McKenna, LLP

(57) ABSTRACT

A jewelry bead has a rigid hollow body with an exterior wall of a first metal and a covering of a second metal whose color is different from that of the first metal. The covering overlies one or more selected areas of the wall so as to define an all-metal substantially level color pattern on the bead. A method of making the jewelry bead is also disclosed.

9 Claims, 1 Drawing Sheet

METHOD OF MAKING STRIPED METAL BEADS

BACKGROUND OF THE INVENTION

1. Field of the Invention

This invention relates to jewelry. It relates more particularly to striped metal beads for making beaded jewelry and to a method of making the beads.

2. Background Information

Beaded jewelry consists of one or more beads strung on an elongated slender support, e.g. chain, wire, string, etc. to form necklaces, pendants, earrings and the like. When the beads are of a precious metal such as gold, silver, platinum or alloys thereof, the entire exterior surface of each bead is usually of the same metal, e.g. gold, silver, etc. Therefore, each bead has essentially the same color over its entire surface area. This is because, due to the small size and round shape of the bead, it is very difficult, if not impossible, to mask the surface of the bead in order to plate or otherwise apply a contrasting color metal to the surface of the bead. Resultantly in order to provide a bead with contrasting colors, a non-metal coating of enamel, ceramic or the like is often applied to the metal surface of the bead. However when such coated beads are strung to form a piece of jewelry, the coatings tend to chip or wear away in time due to frictional contact with adjacent beads and with the wearer's clothing, thereby spoiling the appearance of the jewelry item.

Therefore it would be desirable to be able to provide an all-metal bead which presents contrasting colors at its exterior surface.

SUMMARY OF THE INVENTION

Accordingly, it is an object of the present invention to provide beads for making belts, necklaces, bracelets, anklets and other jewelry articles, which beads have exterior surfaces consisting of different, contrasting color metals.

Another object of the invention is to provide a jewelry bead whose exterior surface comprises at least two different metals which define a substantially level pattern at said surface.

Yet another object of the invention is to provide a jewelry bead which presents alternating different color metal stripes at its exterior surface.

A further object of the invention is to provide a method of making an all-metal bead with a substantially level contrasting color pattern at its exterior surface.

Other objects will, in part, be obvious and will, in part, appear hereinafter.

The invention accordingly comprises the steps and the relation of one or more of such steps with respect to each of the others, and the article possessing the features, properties and relation of elements, which are exemplified in the following detailed description, and the scope of the invention will be indicated in the claims.

Briefly, the all-metal jewelry bead incorporating the invention has an exterior surface comprising at least two different contrasting color metals arranged in a pattern which gives the bead a distinctive exterior design. When the bead is strung with similar beads to form a necklace, bracelet or the like, the plural colored metal beads combine to give the overall jewelry item a particular pleasing appearance. Furthermore, since the beads are made entirely of metal, their distinctive surface patterns do not tend to degrade over time.

As will be seen presently, the all-metal surface pattern on each bead is formed during the bead manufacturing process. Therefore, the pattern is incorporated right into the bead rather than being applied to the bead after the bead is formed. Using the method described herein, all-metal beads can be formed with a variety of different contrasting color surface patterns to suit the needs and desires of the purchasers of fine jewelry.

BRIEF DESCRIPTION OF THE DRAWINGS

The invention description below refers to the accompanying drawings, of which.

DESCRIPTION OF THE PREFERRED EMBODIMENTS

Figure 1A:
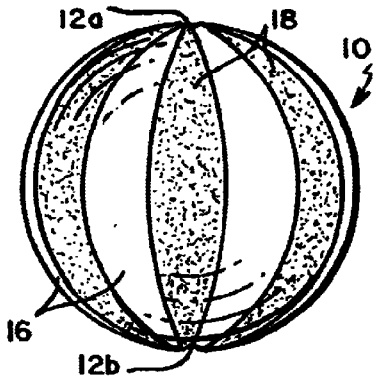
FIGS. 1A and 1B are side elevational and top plan views, respectively, on a very large scale of a striped metal bead incorporating the invention.
Figure 1B:
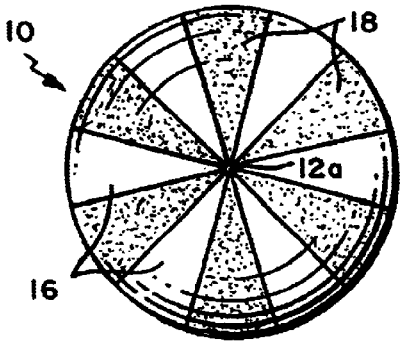

Referring to FIGS. 1A and 1B of the drawings, the subject bead shown generally at 10 is usually provided with a pair of opposite holes 12*a* and 12*b* for stringing the bead. The bead may be formed as a sphere as shown or it may have other shapes such as oblate spheroid, polyhedron, etc. as is well known in the bead manufacturing art.

The illustrated bead 10 has an exterior wall comprising different contrasting color metal areas 16 and 18 which are arranged to give the bead a distinctive exterior surface pattern. In the illustrative bead 10, the bead areas 16 are of gold and the bead areas 18 are of silver and the areas are shaped and arranged to define alternating gold and silver stripes which extend between the bead holes 12*a* and 12*b*. As shown in FIGS. 1A and 1B, the stripe areas are widest at the bead equator and become progressively narrower towards holes 12*a* and 12*b* at the bead poles. The illustrated bead has six each of the striped areas 16, 18. As we shall see, the stripe shape and number are determined during the manufacturing process. Basically, the bead 10 has a stripe pattern similar to the one found on many beach balls. Typically, bead 10 may have an outer diameter of 1–25 mm, or even larger.

Figure 2A:
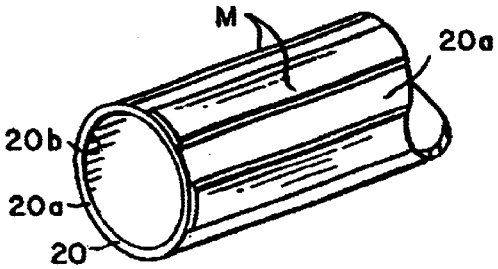
FIGS. 2A to 2D illustrate the method of making the bead in FIGS. 1A and 1B.

Refer now to FIGS. 2A to 2D which depict the various steps involved in making bead 10. Bead 10 originates from a relatively long, large diameter tube 20 having an outer surface or wall 20*a* and an inner surface 20*b* as shown in FIG. 2A. Typically, tube 20 has an outer diameter of 1 inch or more and a wall thickness of 0.010 to 0.200 inch; the length of the tube is optional. Tube 20 may be made entirely of a selected first metal such as gold or gold alloy. Alternatively, in order to reduce costs, tube 20 may be composed of a radially inner substrate of an inexpensive base metal such as brass or copper and a radially outer cladding of the more precious first metal, i.e., gold or gold alloy. In either event, the outer surface or wall 20*a* of tube 20 is of the selected first metal, i.e. gold or gold alloy, e.g. 10 karat or higher.

The first step in the process is to apply masks M to the outer surface 20*a* of tube 20. In the illustrated embodiment, the masks M are in the form of equally wide lengthwise masking strips spaced evenly around the circumference of surface 20*a*.

Figure 2B:
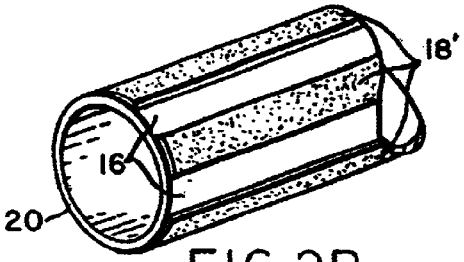

As shown in FIG. 2B, the masked tube 20 is then subjected to a plating operation during which a second metal, e.g. silver, is plated or CVD-deposited onto the unmasked areas of the tube surface 20*a* thereby forming a plurality of second metal stripe areas 18' of selected thickness distributed around the circumference of surface 20*a*. Thus, following the plating step and the removal of masks M, the exterior surface of tube 20 will consist of lengthwise areas 18' of the second metal separated by lengthwise areas 16' of the first metal, i.e. alternating silver and gold stripes.

Figure 2C:
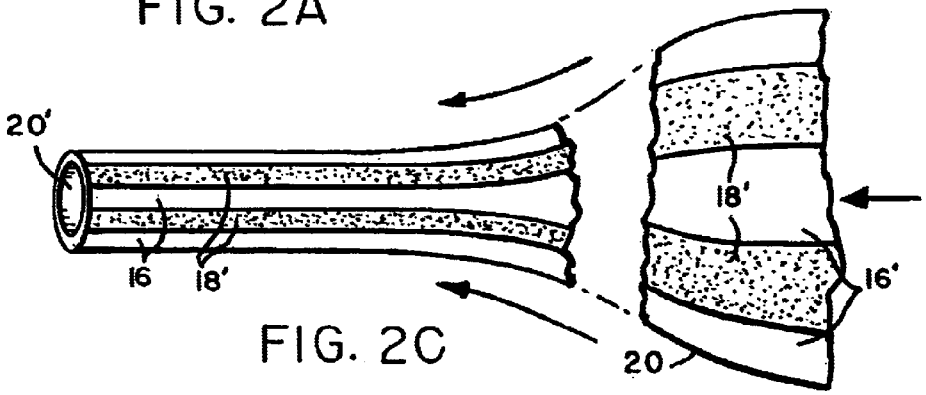

Next, as shown in FIG. 2C, tube 20 is subjected to a conventional drawing operation during which the tube is passed through a series of drawing dies which simultaneously reduces the diameter and wall thickness of tube 20 to form a drawn-down tube 20' having a diameter which is more or less the same as the desired diameter of bead 10 in which case the wall thickness will reduce to about 0.003 inch or larger, with commensurate thinning of areas 18'. The same drawing operation will cause a corresponding extension and reduction in width of the stripe areas 16', 18' thereby producing an elongated tube 20' whose stripe areas may be as narrow as 0.010 inch for a 1 mm bead 10.

Figure 2D:
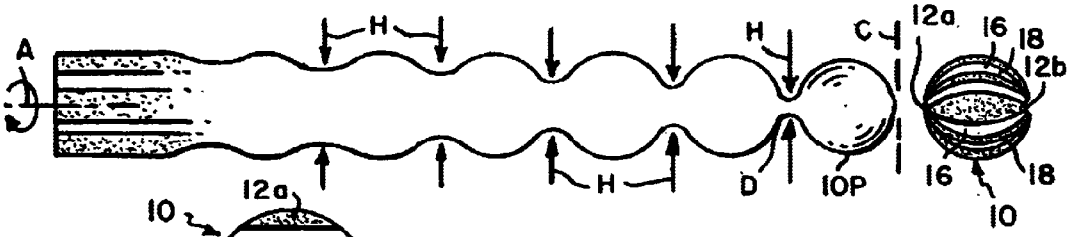

Next, in accordance with FIG. 2D, the reduced diameter tube 20' is subjected to a forming operation. During this forming operation, while rotating tube 20' about its longitudinal axis A, the tube is advanced past a succession of hammers or dies indicated schematically by the arrows H in that figure. The hammers H drive progressively closer to the rotary axis A so that tube 20 is progressively deformed radially inward at spaced-apart locations along the tube as indicated in FIG. 2D as viewed from left to right. In other words, the first hammer H makes a slight circular deformation in the otherwise straight tube 20'. The tube with that circular deformation then travels to the second hammer which makes a slightly deeper deformation at the same place in the tube. That slightly deeper deformation is then advanced to the third hammer which deepens the deformation even more until the tube is deformed or crimped to such an extent that the wall of the tube 20 is necked down to an extreme as shown at D in FIG. 2D. At that point, the diameter of tube 20' has been reduced to an extent that it is almost pinched off so that an end segment of the tube forms a more or less spherical photoshell $\mathbf{10}_p$ which is connected to the rest of tube 20' only at the small annular neck remaining at the depression D. Tube 20' is then advanced passed a cutter C which cuts the tube at the annular depression D so that protoshell $\mathbf{10}_p$ is separated from the remainder of tube 20 thereby forming the all-metal striped bead 10 with holes 12*a*, 12*b* as shown in FIG. 2D. Thus, as tube 20' is advanced through the forming machine, successive beads 10 are cut from the end of the tube until the tube is used up.

The particular shape of bead 10 are determined primarily by the shapes of the hammers or dies H and the cross-sectional shape of tube 20'. While the illustrated bead 10 is spherical, many other bead shapes are possible, e.g. cube, oblate spheroid, etc.

While the drawing-down of tube 20 as shown in FIG. 2C elongates and narrows the gold areas 16' and the silver areas 18' at the surface of tube 20, the forming or crimping of the reduced diameter tube 20' as shown in FIG. 2D progressively narrows those stripes even more in the areas of the crimps so that when each bead 10 is separated from the remainder of tube 20' by cutter C, that bead has the holes 12*a*, 12*b* at the bead poles and the alternating narrow and tapered gold and silver stripes 16, 18 extending between the holes as shown in FIGS. 1A and 1B. Furthermore, since the areas 16', 18' are drawn-down together, the areas 18' are embedded right into the drawn-down tube 20' wall so that there is no discernable change in wall thickness of the bead from stripe to stripe. In other words, the stripe patterns are substantially level all around the bead. After cleaning, the result is a bead 10 having alternating gold and silver stripes 16, 18 with a shiny finish.

If a bead 10 with no holes 12*a*, 12*b* is desired, e.g. for a brooch, earring, pin or the like, the holes 12*a*, 12*b* at the poles of the bead are hammered shut enabling a closed bead to be soldered or otherwise secured to a fixture or fastening device.

A particularly desirable contrasting color visual effect is produced if, following the formation of each all-metal striped bead 10, the bead is subjected momentarily to an acid bath, e.g. nitric acid, which etches the surfaces of the silver areas 18. This has at least two beneficial effects. First, it removes any residual silver that may have been deposited on the surfaces of the gold areas 16. Secondly, it gives the silver areas 18 a matte finish which contrasts sharply with the shiny or glossy finish of the gold areas 16 which are not affected by the acid bath.

Figure 3:
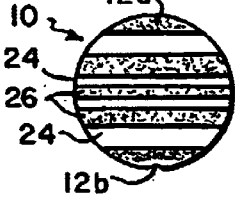
FIG. 3 is a view similar to FIG. 1A on a smaller scale, of a second bead embodiment.

While the illustrated bead 10 has a surface pattern composed of alternating different color metal stripes, it is also possible to produce beads with other surface patterns. For example, if the tube 20 of a first metal, e.g. gold, is plated with a lengthwise series of equally narrow circumferential rings of a second contrasting color metal, e.g. silver, after the tube is drawn and formed as indicated in FIGS. 2C and 2D, the resultant bead 22 shown in FIG. 3 will have at its surface alternating, circumferential gold and silver rings 24 and 26, respectively, which are narrowest midway between the holes 12*a* and 12*b*, i.e. at the bead equator, and which become progressively wider as they approach those holes. This is because the original narrow rings will become equally wide during the drawing process of FIG. 2C. Then, during the forming process of FIG. 2D, in the areas of the crimps, the rings will become progressively wider.

The illustrated plated tube 20' for making the illustrated bead 10 has equally wide areas 16', 18'. Using appropriately dimensioned, shaped and placed masks M on tube 20, it is possible to provide a tube 20' with different width areas 16', 18' or areas with non-straight, e.g. sinusoidal, zigzag, etc., shapes which will result in various, plural color patterns at the surface of the resultant bead.

Also, while the illustrated bead 10 has a surface pattern composed of gold and silver, it is also possible to use other different color metals, such as platinum, copper, etc. to produce other design effects wholly of metal at the surface of the bead. Furthermore, the original tube 20 can be plated with several different color metals by successive masking operations to produce beads with more elaborate all-metal surface designs or patterns.

It will thus be seen that the objects set forth above, among those made apparent from the preceding description, are efficiently attained.

Also, certain changes may be made in carrying out the above method and in the constructions set forth without departing from the scope of the invention. Therefore, it is intended that all matter contained in the above description or shown in the accompanying drawings shall be interpreted as illustrative and not in a limiting sense.

It is also to be understood that the following claims are intended to cover all of the generic and specific features of the invention described herein

What is claimed is:

1. A method of making a jewelry bead comprising the steps of providing a rigid tube having an exterior wall of a first metal and a relatively large cross-sectional area;

depositing a second metal on one or more selected areas of said wall;

drawing down said tube so as to substantially reduce the diameter and wall thickness of said tube while elongating said tube thereby forming a drawn-down tube wherein the second metal is embedded into said selected areas of said wall;

progressively deforming the drawn-down tube radially inward at selected locations along the length thereof;

continuing the deformation until the drawn-down tube forms a protobead at an end of the drawn-down tube which is connected to the remainder of the drawn-down tube solely by a small diameter annular neck, and separating the protobead from the remainder of the drawn-down tube at said neck to form a hollow bead with a substantially level, all-metal color pattern on the bead.

2. The method defined in claim 1 including the step of, while separating the protobead, forming holes at the opposite poles of the bead.

3. The method defined in claim 2 including the additional step of closing the holes formed during the separating step.

4. The method defined in claim 1 including depositing the second metal on the tube wall as one or more lengthwise stripes extending between said poles.

5. The method defined in claim 1 including forming the tube as a cylinder, and depositing the second metal on the tube wall as a lengthwise series of closely spaced, narrow circular stripes spaced apart between said poles.

6. The method defined in claim 1 wherein the providing step provides a tube with an exterior wall of gold or gold alloy.

7. The method defined in claim 6 wherein silver or silver alloy is deposited as the second metal.

8. The method defined in claim 1 including the additional step of etching the surface of the bead to provide a matte surface finish at the second metal areas of the bead.

9. The method defined in claim 1 including, before the depositing step, applying one or more masks to the exterior wall of the tube to define said selected areas, and after the depositing step, removing the one or more masks.

* * * * *